US011056790B2

(12) United States Patent
Xu

(10) Patent No.: US 11,056,790 B2
(45) Date of Patent: Jul. 6, 2021

(54) ANTENNA SYSTEM AND MOBILE TERMINAL

(71) Applicant: AAC Technologies Pte. Ltd., Singapore (SG)

(72) Inventor: Xinying Xu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 29 days.

(21) Appl. No.: 16/524,082

(22) Filed: Jul. 28, 2019

(65) Prior Publication Data

US 2020/0044348 A1 Feb. 6, 2020

(30) Foreign Application Priority Data

Aug. 3, 2018 (CN) ..... 201821252395.4

(51) Int. Cl.

| | |
|---|---|
| ***H01Q 9/04*** | (2006.01) |
| ***H01Q 1/24*** | (2006.01) |
| ***H01Q 5/50*** | (2015.01) |
| ***H01Q 5/328*** | (2015.01) |

(52) U.S. Cl.

CPC ..... *H01Q 9/0414* (2013.01); *H01Q 1/243* (2013.01); *H01Q 1/245* (2013.01); *H01Q 5/328* (2015.01); *H01Q 5/50* (2015.01)

(58) Field of Classification Search

CPC ..... H01Q 9/0414; H01Q 1/245; H01Q 5/50; H01Q 5/328; H01Q 1/243; H01Q 21/28; H01Q 5/378; H01Q 9/42

USPC ..... 343/702

See application file for complete search history.

(56) References Cited

U.S. PATENT DOCUMENTS

| | | | | |
|---|---|---|---|---|
| 2008/0062049 | A1* | 3/2008 | Soler Castany | H01Q 1/38 343/702 |
| 2012/0313825 | A1* | 12/2012 | Kuramoto | H01Q 5/40 343/700 MS |
| 2014/0062801 | A1* | 3/2014 | Yong | H01Q 9/42 343/702 |
| 2014/0292590 | A1* | 10/2014 | Yoo | H01Q 1/243 343/702 |
| 2015/0244061 | A1* | 8/2015 | Galeev | H01Q 1/50 343/702 |
| 2016/0043812 | A1* | 2/2016 | Bolin | H04M 1/0202 455/550.1 |
| 2017/0229762 | A1* | 8/2017 | Zheng | G01S 3/085 |
| 2017/0358844 | A1* | 12/2017 | Wu | H01Q 1/50 |
| 2018/0007181 | A1* | 1/2018 | Lee | H05K 5/04 |
| 2019/0214729 | A1* | 7/2019 | Chen | H01Q 5/328 |

(Continued)

*Primary Examiner* — Don P Le

(74) *Attorney, Agent, or Firm* — W&G Law Group LLP

(57) ABSTRACT

The present disclosure provides an antenna system, including a mainboard having a system ground, a metal frame disposed around the mainboard and being closed-loop without any breakpoints, a first wire, a second wire, a third wire, a feed terminal, and a ground terminal. The system ground is electrically connected to the metal frame. The first wire is connected to the feed terminal and is opposite to and spaced apart from the metal frame, so that the first wire forms a first antenna unit. The second wire is connected to the ground terminal and is spaced apart from the first wire, and the second wire and the first wire are at least partially opposite, so that the second wire and the first wire are coupled with each other, to form a second antenna unit.

10 Claims, 6 Drawing Sheets

(56) References Cited

U.S. PATENT DOCUMENTS

| | | | | |
|---|---|---|---|---|
| 2020/0044315 | A1* | 2/2020 | Gu | H01Q 5/328 |
| 2020/0044348 | A1* | 2/2020 | Xu | H01Q 5/50 |
| 2020/0203804 | A1* | 6/2020 | Khripkov | H01Q 1/243 |
| 2020/0203805 | A1* | 6/2020 | Chen | H01Q 1/243 |
| 2020/0287274 | A1* | 9/2020 | Zhang | H01Q 1/44 |

* cited by examiner

ANTENNA SYSTEM AND MOBILE TERMINAL

TECHNICAL FIELD

The present disclosure relates to the field of wireless communications technologies, more particular to an antenna system and a mobile terminal.

BACKGROUND

Currently, communications devices having a metal housing, such as mobile phones, have become a mainstream structure of major brands of mobile phones. When an antenna of a mobile phone is designed, slits are usually disposed in a metal frame of the metal housing, to satisfy an antenna band performance requirement. However, an excessively large width of the slit will influence the structural strength and appearance texture of the entire mobile phone; an excessively small width will cause parts on two sides of the slit to be coupled with each other, and a smaller width of the slit indicates stronger coupling, influencing the antenna performance severely. Apparently, it is quite difficult for the metal housing of a slit type to meet requirements for structural strength, appearance texture, and antenna performance of the mobile phone at the same time Therefore, it is actually necessary to provide a new antenna to resolve the above problems.

DETAILED DESCRIPTION

Figure 1:
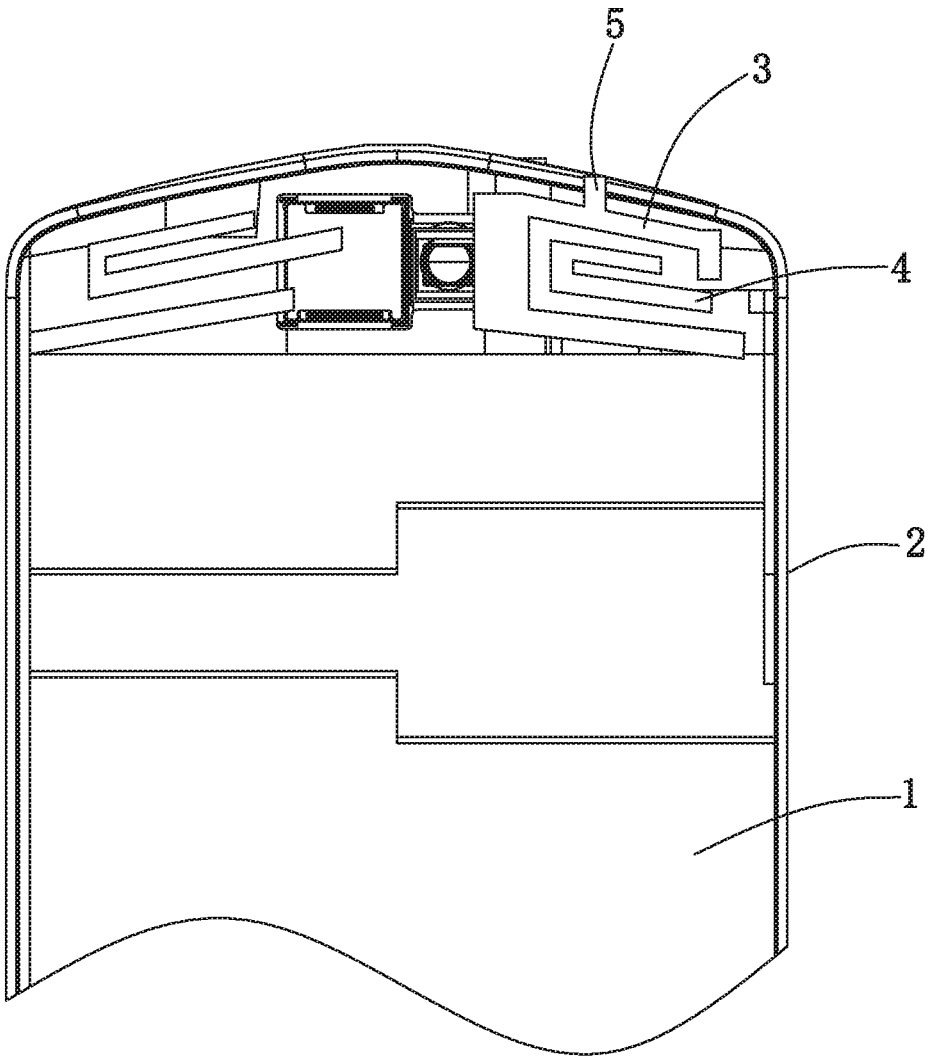
FIG. 1 is a schematic structural diagram of an antenna system according to a specific embodiment of the present disclosure.
Figure 2:
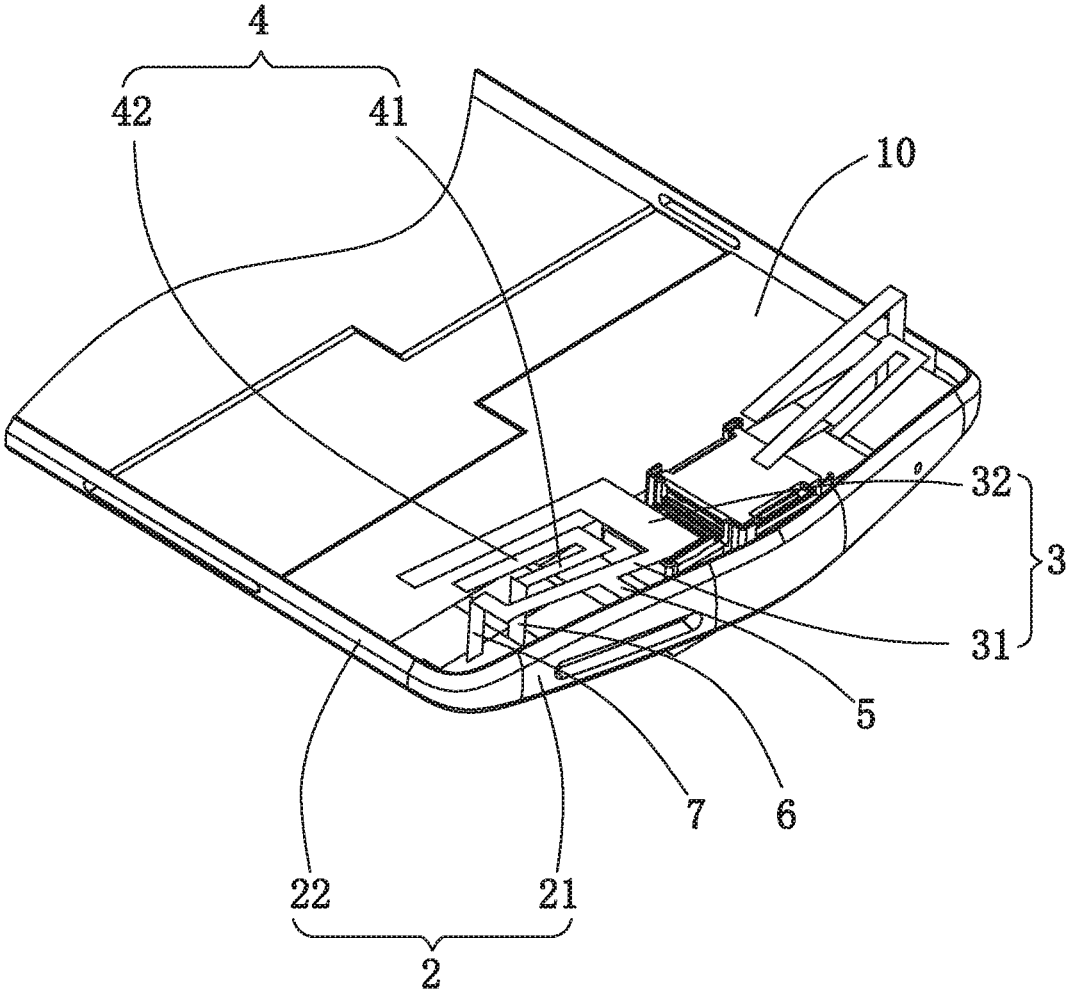
FIG. 2 is a schematic structural diagram of a part of the antenna system shown in FIG. 1.
Figure 3:
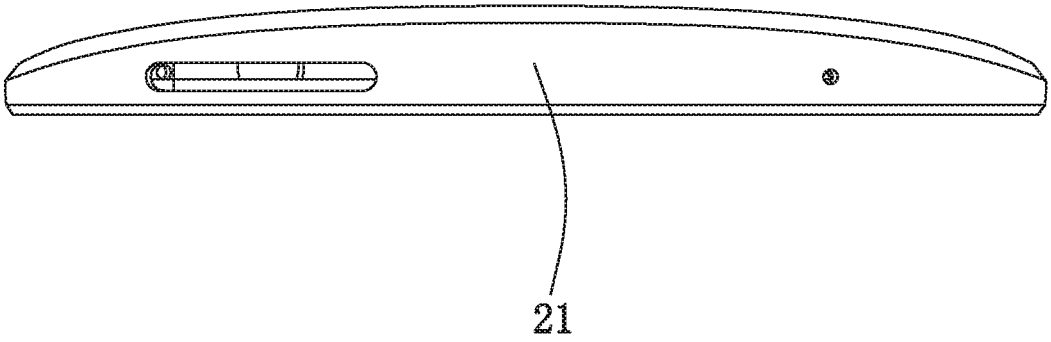
FIG. 3 is a bottom view of the antenna system shown in FIG. 1.
Figure 4:
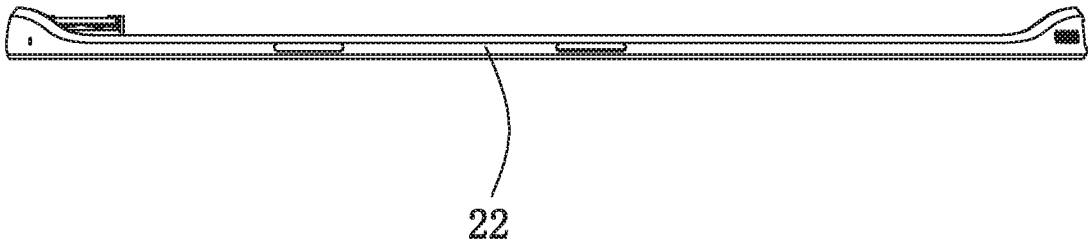
FIG. 4 is a side view of the antenna system shown in FIG. 1.
Figure 5:
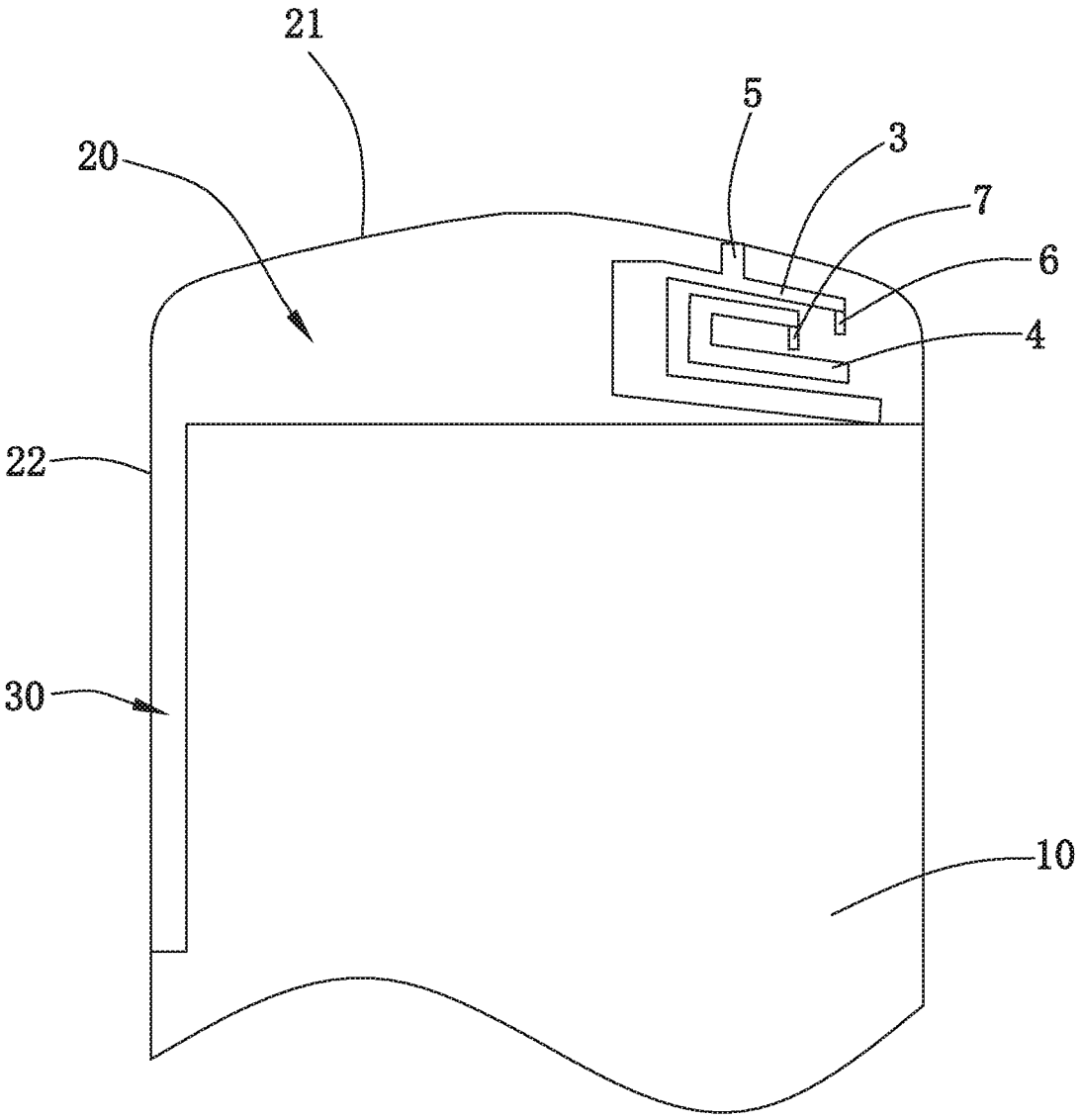
FIG. 5 is a schematic diagram showing a structure of the antenna system shown in FIG. 1.

The following clearly and completely describes the technical solutions in the embodiments of the present disclosure with reference to the accompanying drawings in the embodiments of the present disclosure. Apparently, the described embodiments are merely a part rather than all of the embodiments of the present disclosure.

As shown in FIG. 1 to FIG. 5, an embodiment of the present disclosure provides a mobile terminal such as a mobile phone or a personal digital assistant. The mobile terminal includes an antenna system.

Specifically, the antenna system includes a mainboard 1 having a system ground 10, a metal frame 2 disposed around the mainboard 1 and being closed-loop without any breakpoints, a first wire 3, a second wire 4, a third wire 5, a feed terminal 6, and a ground terminal 7. Generally, the system ground 10 may be a metal layer laid on the mainboard 1, and the system ground 10 is electrically connected to the metal frame 2, so that the metal frame 2 is grounded. The metal frame is of an annular structure, and no breakpoint exists along the periphery of the metal frame 2. The antenna system further includes a feed point disposed on the mainboard 1 and a ground point connected to the system ground 10, where the feed terminal 6 is connected to the feed point and the ground terminal 7 is connected to the ground point.

The first wire 3 is connected to the feed terminal 6 and is opposite to and spaced apart from the metal frame 2, so that the first wire 3 and the metal frame 2 are coupled with each other, to form a first antenna unit.

The second wire 4 is connected to the ground terminal 7 and is spaced apart from the first wire 3, and the second wire 4 and the first wire 3 are at least partially opposite. Generally, a part of the second wire 4 far away from the ground terminal 7 is opposite to a part of the first wire 3 far away from the feed terminal 6, so that the second wire 4 and the first wire 3 are coupled with each other, to form a second antenna unit. Generally, a shape of the first wire 3 is roughly the same as that of the second wire 4.

One end of the third wire 5 is connected between the feed terminal 6 and an end of the first wire 3, and the other end is connected to the metal frame 2, so that the first wire 3 is electrically connected to the metal frame 2, to form a third antenna unit.

In the antenna system, the first antenna unit is formed by the first wire 3, the second antenna unit is formed by the second wire 4 and the first wire 3 being opposite to, spaced apart from, and coupled with each other, and the third antenna unit is formed by the third wire 5 being connected to the first wire 3 and the metal frame 2, thereby implementing radiation of the antenna system. In the antenna system, breakpoints do not need to be disposed in the metal frame 2. The metal frame 2 is of a closed-loop structure, thereby strengthening a structural strength of the entire mobile terminal and improving an appearance defect of having slits in the metal frame in the existing technology. Because precise matching on sizes of slits is not required, the production costs and production hours are largely reduced, and a large quantity of tolerance control areas are reduced. In this way, the yield of the products can be improved and the actual antenna performance is not lowered.

The first wire 3, the second wire 4, the third wire 5, the feed terminal 6, and the ground terminal 7 are each of a sheet-shaped structure. The first wire 3, the second wire 4, and the third wire 5 are disposed in a same plane, and the feed terminal 6 and the ground terminal 7 are disposed in a plane perpendicular to the plane in which the first wire 3 is disposed.

Generally, the first wire 3 is disposed at an outer side of the second wire 4 and is disposed around the second wire 4. Therefore, the shape of the first wire 3 is roughly the same as that of the second wire 4. Specifically, the first wire 3 includes a first connection portion 31 of an L-shape and a first extension portion 32 of an L-shape bending and extending from one end of the first connection portion 31, and the first connection portion 31 and the first extension portion 32 define a rectangular structure having a notch. The other end of the first connection portion 31 is connected to the feed terminal 6. The second wire 4 includes a second connection portion 41 of a long strip shape and a second extension portion 42 of an L-shape bending and extending from one end of the second connection portion 41, and the other end of the second connection portion 41 is connected to the ground terminal 7. The second wire 4 is disposed in the rectangular structure defined by the first connection portion 31 and the first extension portion 32. The third wire 5 is vertically connected to an intermediate position of the first connection portion 31.

There may be one or more joints of the system ground 10 and the metal frame 2.

Optionally, the metal frame 2 includes a top frame 21 and two side frames 22 disposed opposite to two ends of the top frame 21. A clearance area 20 is disposed between the system ground 10 and the top frame 21, and the first wire 3, the second wire 4, and the third wire 5 are disposed in the clearance area 20. The system ground 10 is connected to one of the side frames 22, a gap 30 is left between the system ground 10 and the other of the side frames 22, and the gap 30 is in communication with the clearance area 20. Preferably, the third wire 5 is of a long strip shape, connected to the top frame 21, and parallel to the side frames 22. Because the first wire 3, the second wire 4, and the third wire 5 are usually flexible printed circuit (FPC) antenna wires or laser direct structuring (LDS) antenna wires, the antenna system further includes a holder (not shown) made of a non-metal material, for example, the holder is a plastic part. The first wire 3, the second wire 4, and the third wire 5 are disposed in the clearance area 20 through the holder, to support the first wire 3, the second wire 4, and the third wire 5 through the holder, facilitating the installation of the antenna system in the mobile terminal.

Figure 6:
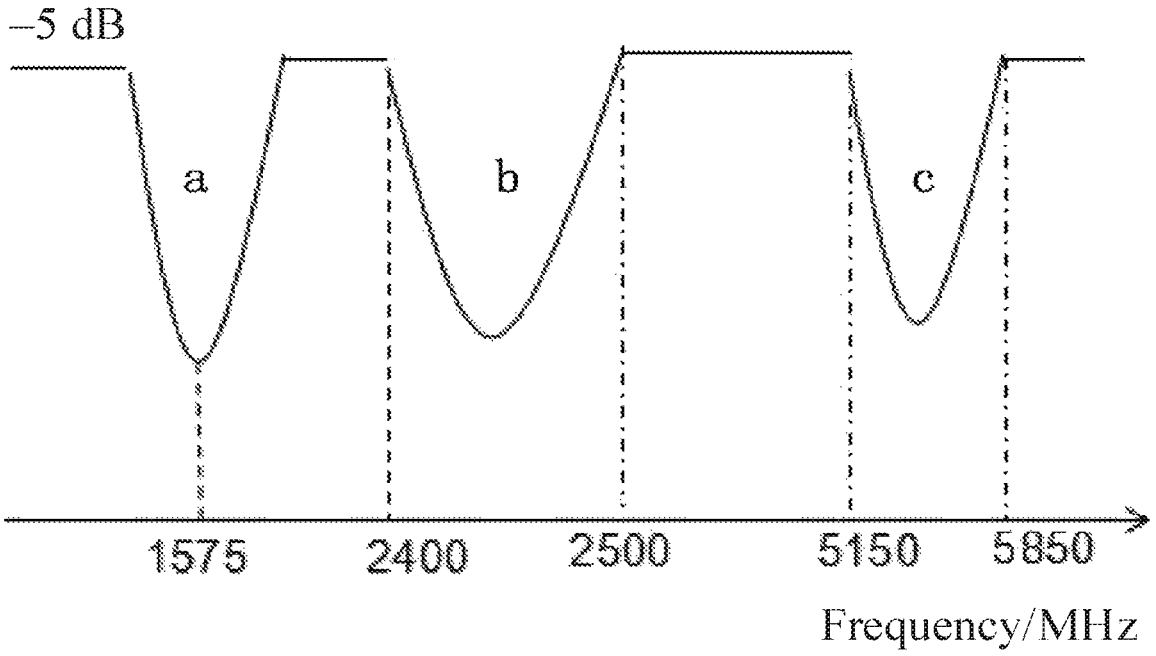
FIG. 6 is a schematic diagram showing a band of an antenna system according to the present disclosure.

FIG. 6 is a schematic diagram showing a band of an antenna system according to the present disclosure. The antenna system roughly forms three band ranges a, b, and c, where a represents the band range of the first antenna unit having an operating band of 1550 to 1620 MHz, b represents the band range of the second antenna unit having an operating band of 2400 to 2500 MHz, and c represents the band range of the third antenna unit having an operating band of 5150 to 5850 MHz.

Figure 7:
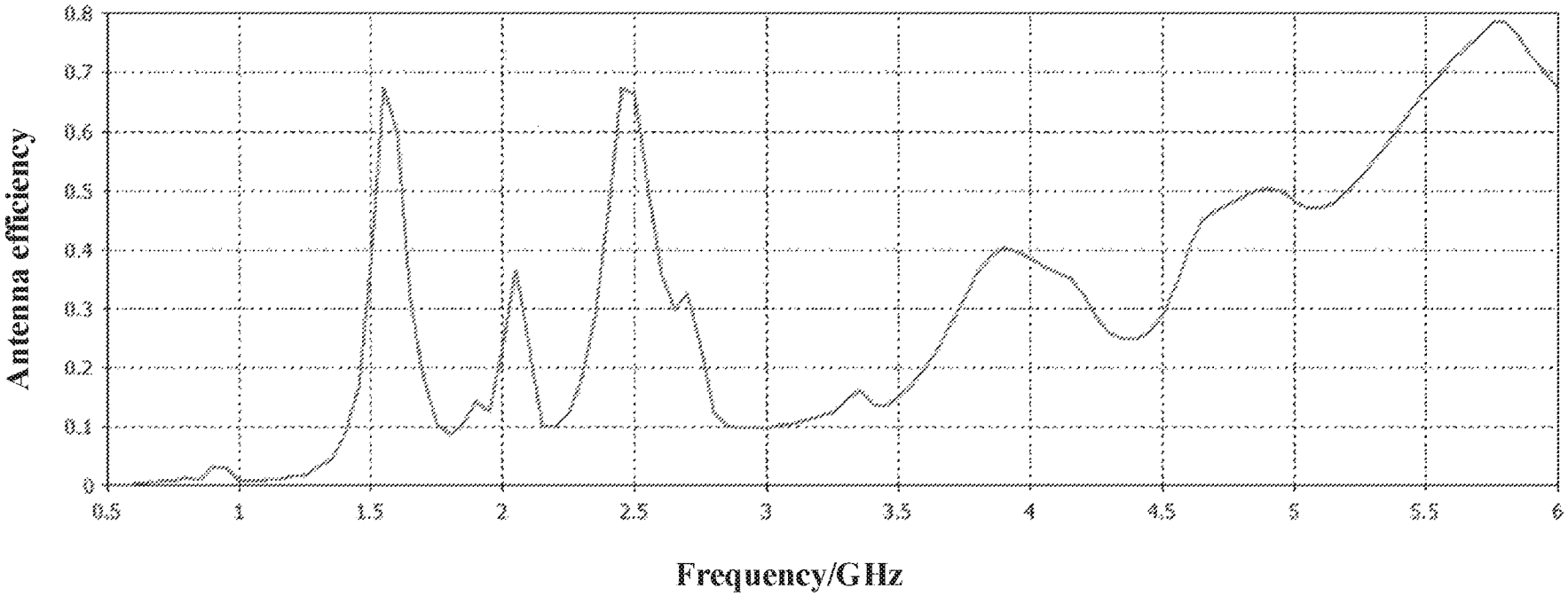
FIG. 7 is a schematic diagram showing antenna efficiency of an antenna system according to the present disclosure.

FIG. 7 is a schematic diagram showing antenna efficiency of an antenna system according to the present disclosure. The test result indicates that the antenna efficiency of the antenna system is greater than 65% in the entire operating band (1550 to 1620 MHz, 2400 to 2500 MHz, and 5150 to 5850 MHz), indicating that the antenna system has good antenna performance.

Compared with the related art, the antenna system and the mobile terminal provided in the present disclosure have the following beneficial effects:

1) The first antenna unit is formed by the first wire, the second antenna unit is formed by the second wire and the first wire being opposite to, spaced apart from and coupled with each other, and the third antenna unit is formed by the third wire being connected to the first wire and the metal frame, thereby implementing radiation of the antenna system; in the antenna system, breakpoints do not need to be disposed in the metal frame; the metal frame is of a closed-loop structure, thereby strengthening a structural strength of the entire mobile terminal and improving an appearance defect of having slits in the metal frame in the existing technology;

2) Because slits do not need to be disposed in the metal frame, that is, precise matching on sizes of slits is saved, the production costs and production hours are largely reduced, and a large quantity of tolerance control areas are reduced. In this way, the yield of the products can be improved and the actual antenna performance is not lowered.

The foregoing descriptions are merely embodiments of the present disclosure but are not intended to limit the patent scope of the present disclosure, an equivalent structure or equivalent procedure replacement made based on the content of the specification and the accompanying drawings of the present disclosure or directly or indirectly applied in other relevant technical fields is included in the patent protection scope of the present disclosure.

What is claimed is:

1. An antenna system, comprising a mainboard having a system ground, a metal frame disposed around the mainboard and being closed-loop without any breakpoints, a first wire, a second wire, a third wire, a feed terminal, and a ground terminal;

the system ground is electrically connected to the metal frame;

the first wire is connected to the feed terminal and is opposite to and spaced apart from the metal frame, so that the first wire forms a first antenna unit;

the second wire is connected to the ground terminal and is spaced apart from the first wire, and the second wire and the first wire are at least partially opposite, the first wire is disposed at an outer side of the second wire and surrounds the second wire so that the second wire and the first wire are coupled with each other, to form a second antenna unit; and one end of the third wire is connected between the feed terminal and an end of the first wire, and the other end is connected to the metal frame, so that the first wire is electrically connected to the metal frame, to form a third antenna unit.

2. The antenna system according to claim 1, wherein the first wire comprises a first connection portion of an L-shape, and a first extension portion of an L-shape bending and extending from one end of the first connection portion, the other end of the first connection portion is connected to the feed terminal, and the first connection portion and the first extension portion define a rectangular structure having a notch;

the second wire comprises a second connection portion of a long strip shape and a second extension portion of an L-shape bending and extending from one end of the second connection portion, and the other end of the second connection portion is connected to the ground terminal;

the second wire is disposed in the rectangular structure defined by the first connection portion and the first extension portion; and the third wire is connected to the first connection portion.

3. The antenna system according to claim 1, wherein the first wire, the second wire, and the third wire are disposed in a same plane, and the feed terminal and the ground terminal are disposed in a plane perpendicular to the plane in which the first wire is disposed.

4. The antenna system according to claim 2, wherein the first wire, the second wire, and the third wire are disposed in a same plane, and the feed terminal and the ground terminal are disposed in a plane perpendicular to the plane in which the first wire is disposed.

5. The antenna system according to claim 1, wherein the metal frame comprises a top frame and two side frames disposed opposite to two ends of the top frame;

a clearance area is disposed between the system ground and the top frame, and the first wire, the second wire, and the third wire are disposed in the clearance area; and the system ground is connected to one of the side frames, a gap is left between the system ground and the other of the side frames, and the gap is in communication with the clearance area.

6. The antenna system according to claim 5, wherein the third wire is of a long strip shape, connected to the top frame, and parallel to the side frames.

7. The antenna system according to claim 5, wherein the antenna system further comprises a holder made of a non-metal material, and the first wire, the second wire, and the third wire are disposed in the clearance area through the holder.

8. The antenna system according to claim 7, wherein the first wire, the second wire, and the third wire are FPC antenna wires or LDS antenna wires located on a surface of the holder.

9. The antenna system according to claim 1, wherein an operating band of the first antenna unit is 1550 to 1620 MHz; an operating band of the second antenna unit is 2400 to 2500 MHz; and an operating band of the third antenna unit is 5150 to 5850 MHz.

10. A mobile terminal, comprising the antenna system according to claim 1.

* * * * *